US009972920B1

(12) United States Patent
Shimada et al.

(10) Patent No.: US 9,972,920 B1
(45) Date of Patent: May 15, 2018

(54) TERMINAL AND TERMINAL-EQUIPPED ELECTRIC WIRE

(71) Applicants: AutoNetworks Technologies, Ltd., Yokkaichi, Mie (JP); Sumitomo Wiring Systems, Ltd., Yokkaichi, Mie (JP); SUMITOMO ELECTRIC INDUSTRIES, LTD., Osaka-shi, Osaka (JP)

(72) Inventors: Takanobu Shimada, Mie (JP); Takuji Ootsuka, Mie (JP); Yoshihisa Yokoyama, Mie (JP); Takahiko Hamaguchi, Mie (JP); Takehiro Nakata, Mie (JP); Satoshi Morikawa, Mie (JP); Hiroshi Hamada, Mie (JP); Hiroki Hirai, Mie (JP); Junichi Ono, Mie (JP)

(73) Assignees: AutoNetworks Technologies, Ltd., Yokkaichi, Mie (JP); Sumitomo Wiring Systems, Ltd, Yokkaichi, Mie (JP); SUMITOMO ELECTRIC INDUSTRIES, LTD, Osaka-shi, Osaka (JP)

( * ) Notice: Subject to any disclaimer, the term of this patent is extended or adjusted under 35 U.S.C. 154(b) by 0 days. days.

(21) Appl. No.: 15/564,270

(22) PCT Filed: Mar. 30, 2016

(86) PCT No.: PCT/JP2016/060343
§ 371 (c)(1),
(2) Date: Oct. 4, 2017

(87) PCT Pub. No.: WO2016/167125
PCT Pub. Date: Oct. 20, 2016

(30) Foreign Application Priority Data

Apr. 16, 2015 (JP) ..... 2015-084268

(51) Int. Cl.
*H01R 4/18* (2006.01)

(52) U.S. Cl.
CPC ..... *H01R 4/185* (2013.01)

(58) Field of Classification Search
CPC ..... H01R 4/185
(Continued)

(56) References Cited

U.S. PATENT DOCUMENTS 7,722,416 B2 * 5/2010 Gump ..... H01R 4/188 439/879
8,485,853 B2 * 7/2013 Seifert ..... H01R 4/188 439/882

(Continued)

FOREIGN PATENT DOCUMENTS

JP H0572053 U 9/1993
JP 2013171753 A 9/2013

OTHER PUBLICATIONS

International Preliminary Report on Patentability for Application No. PCT/JP2016/060343 dated Aug. 15, 2016; 6 pages.

(Continued)

*Primary Examiner* — Tulsidas C Patel
*Assistant Examiner* — Travis Chambers
(74) *Attorney, Agent, or Firm* — Reising Ethington, P.C.

(57) ABSTRACT

A terminal that is connected to an end of an aluminum electric wire obtained by covering core wires with an insulating cover. The terminal is provided with a pair of insulation barrel pieces (crimping pieces) that extend in directions that intersect the longitudinal direction of the aluminum electric wire, and are crimped to the outer circumferential surface of the insulating cover. The pair of insulation barrel pieces have tip end portions that face and abut against each other in a state in which the pair of insulation barrel pieces are crimped to the insulating cover.

2 Claims, 4 Drawing Sheets

(58) Field of Classification Search
USPC ..... 439/866, 877, 878, 882
See application file for complete search history.

(56) References Cited

U.S. PATENT DOCUMENTS

| | | | | |
|---|---|---|---|---|
| 8,622,775 | B2 * | 1/2014 | Takashima | H01R 4/024 439/886 |
| 9,136,628 | B2 * | 9/2015 | Aizawa | H01R 4/185 |
| 9,184,541 | B2 * | 11/2015 | Miyamoto | H01R 4/206 |
| 9,627,103 | B2 * | 4/2017 | Rachi | H01B 7/2806 |
| 2013/0133946 | A1 * | 5/2013 | Morikawa | H01R 4/185 174/77 R |

OTHER PUBLICATIONS

International Search Report for Application No. PCT/JP2016/060343 dated May 24, 2016; 4 pages.

* cited by examiner

TERMINAL AND TERMINAL-EQUIPPED ELECTRIC WIRE

CROSS REFERENCE TO RELATED APPLICATIONS

This application claims the priority of Japanese patent application JP2015-084268 filed on Apr. 16, 2015, the entire contents of which are incorporated herein.

TECHNICAL FIELD

The technique disclosed in the present description relates to a terminal and a terminal-equipped electric wire.

BACKGROUND ART

In recent years, in the field of, for example, wire harnesses such as those for automobiles, aluminum electric wires have been used to save weight and the like. Aluminum electric wires have a structure in which their core wires are made of, for example, stranded wires obtained by twisting a plurality of aluminum bar wires together, and are covered with an insulating cover. If the aluminum electric wires are bundled into harnesses, terminals are typically connected to ends of the electric wires. Specifically, the insulating cover of an aluminum electric wire is stripped at an end so that ends of the core wires are exposed, and a wire barrel (electric wire connection portion) of the terminal is crimped and connected to the exposed ends of the core wires, and an insulation barrel provided rearward of the wire barrel is crimped to the remaining end of the insulating cover.

JP2011-192530A is an example of background prior art.

SUMMARY

Meanwhile, recently, aluminum electric wires with a smaller diameter compared to conventional aluminum electric wires have been manufactured to further save weight. However, such a small-diameter aluminum electric wire has low impact resistance, and thus its portion crimped by the wire barrel is relatively easy to break if the wire connected to the terminal is subjected to a large impact.

To prevent breakage of the aluminum electric wire, a method is conceivable in which the retention strength of the insulation barrel is increased to reduce the impact exerted on the portion crimped by the wire barrel. However, if the insulation barrel undergoes high compression when being crimped on the insulating cover in order to increase its retention strength, the following problems will arise.

That is, in a so-called overlapping type in which a pair of insulation barrel pieces are pressed against each other with one of them overlaid on the upper surface of the other, if the insulating cover undergoes high compression, then an edge in an edge portion of a tip end surface of the inner insulation barrel piece will bite into the insulating cover and locally exert a large force. This may result in a disadvantage in that the insulating cover is damaged and broken if the wire is abruptly drawn to the rear. Therefore, in the overlapping type, it is difficult to increase the crimping strength of the insulation barrel.

Furthermore, in another type in which a pair of insulation barrel pieces are arranged shifted with respect to each other in a direction in which the electric wire extends, and are pressed against each other at different positions located frontward and rearward, it is difficult to press the insulation barrel pieces against each other with a uniform force over the entire portion in the circumferential direction of the insulating cover, and thus there is the problem that no sufficient retention strength can be obtained.

As described above, it is difficult to increase the retention strength of the insulation barrels of both types.

The technique disclosed in the present description was made in view of the above-described problems, and it is an object thereof to provide a terminal and a terminal-equipped electric wire in which crimping pieces that are crimped to an outer circumferential surface of an insulating cover have high retention strength.

The technique disclosed in the present description relates to a terminal that is to be connected to an end of an aluminum electric wire obtained by covering core wires with an insulating cover, the terminal including: a pair of crimping pieces that extend in directions that intersect a longitudinal direction of the aluminum electric wire, and are crimped to an outer circumferential surface of the insulating cover, wherein the pair of crimping pieces have tip end portions that face and abut against each other in a state in which the pair of crimping pieces are crimped to the insulating cover.

Furthermore, the technique disclosed in the present description relates to a terminal-equipped electric wire that is provided with: an aluminum electric wire obtained by covering core wires with an insulating cover; and the above-described terminal that is connected to the aluminum electric wire.

According to the above-described configuration, as a result of the tip end portions of the pair of crimping pieces facing and abutting against each other, edge portions of the tip end portions are in contact with each other, and the inner peripheral surfaces, on the insulating cover side, of the crimping pieces are substantially contiguous. Accordingly, edges in the edge portions of the tip end portions are unlikely to bite into the insulating cover, and the insulating cover is prevented from being damaged even if the crimping pieces undergo high compression when being crimped. Furthermore, as a result of the length of the crimping pieces being preset to have a desired compressibility with respect to the insulating cover, it is possible to obtain a desired compressibility in the crimped state.

Furthermore, the tip end portions of the terminal may each have an inner edge portion that is arranged on the insulating cover side, the inner edge portion serving as an inclined portion that is cut off at an angle toward the tip end of the corresponding crimping piece.

When the crimping pieces are strongly crimped on the insulating cover, there may be cases where, during the crimping, the insulating cover is pushed and caught between the tip end portions of the pair of crimping pieces. But, providing such inclined portions makes it possible for the portion that would have come close to being caught to escape into a mountain-shaped region enclosed by the pair of inclined portions, and be prevented from being caught.

According to the technique disclosed in the present description, it is possible to achieve a terminal and a terminal-equipped electric wire in which crimping pieces have high retention strength.

DESCRIPTION OF EMBODIMENTS

Figure 1:
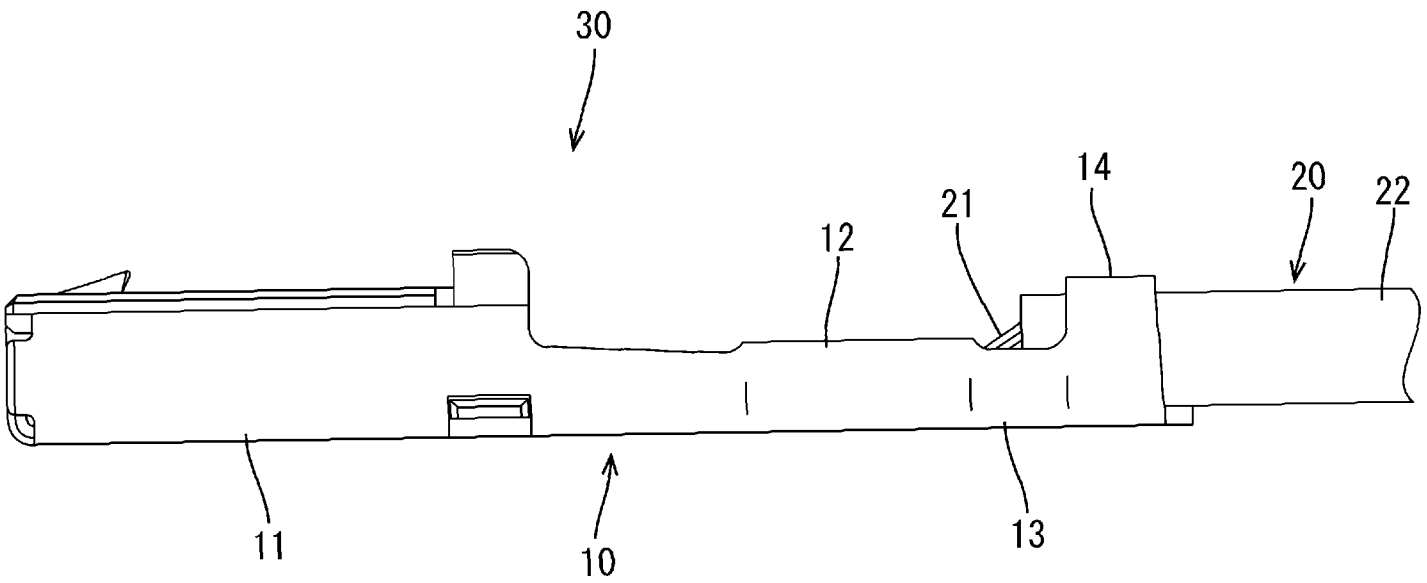
FIG. 1 is a side view illustrating a terminal-equipped electric wire according to one embodiment.

One embodiment will be described with reference to FIGS. 1 to 5.

The present embodiment shows an example of a terminal-equipped electric wire 30 that is laid in a vehicle, for example. This terminal-equipped electric wire 30 is configured to include a female terminal 10, and an aluminum electric wire 20 that is connected to the female terminal 10, and is drawn rearward from the female terminal 10 (see FIG. 1). Note that in the following description, "front" refers to the left side of FIG. 1, "rear" refers to the right side, "upper" refers to the upper side, and "lower" refers to the lower side. Furthermore, "left" refers to the lower right of FIG. 2, and "right" refers to the upper left.

The aluminum electric wire 20 has a structure in which its core wires 21 are made of stranded wires obtained by twisting together a plurality of bar wires made of aluminum or an aluminum alloy, and are covered with an insulating cover 22 made of a synthetic resin. The insulating cover 22 of the aluminum electric wire 20 is stripped at one end so that the core wires 21 are exposed to the front from the insulating cover 22, and the female terminal 10 is connected to that end.

The female terminal 10 is formed by, for example, punching and bending a base material made of a copper alloy, and includes, as shown in FIG. 1: a terminal connection portion 11; a wire barrel 12 that is connected to the core wires 21 of the aluminum electric wire 20; an insulation barrel 14 that is crimped to the insulating cover 22 of the aluminum electric wire 20; and an interposed portion 13 that is interposed between the wire barrel 12 and the insulation barrel 14. The terminal connection portion 11 has the shape of a rectangular tubular box into which a tab of a not-shown male terminal is inserted, and is configured to be electrically connected to the male terminal.

Figure 2:
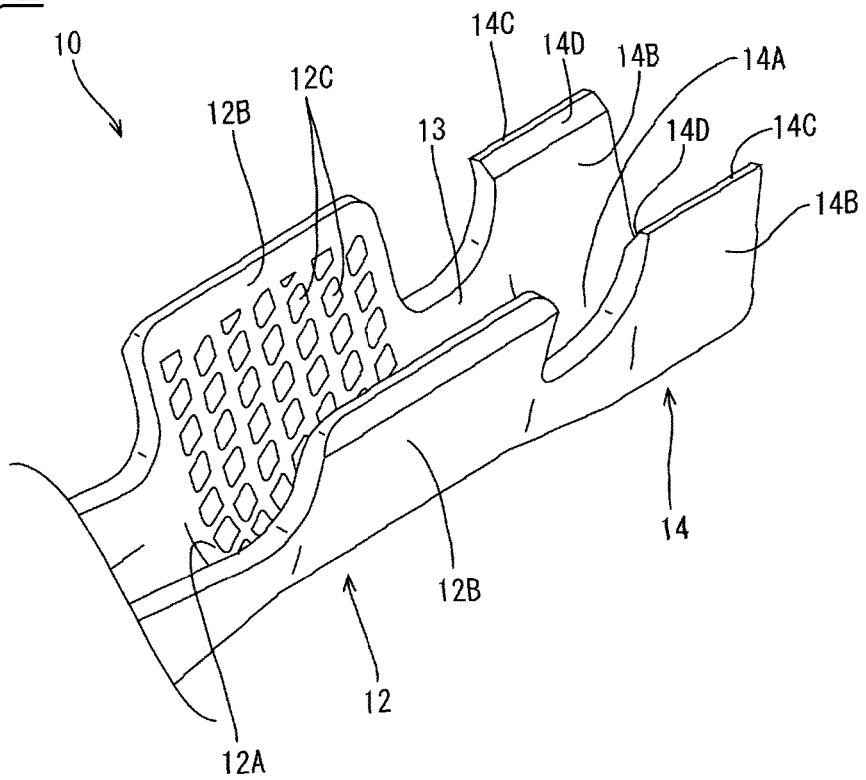
FIG. 2 is a perspective view illustrating an enlarged main portion of a female terminal.

The wire barrel 12 is of an open barrel type, and has, as shown in FIG. 2, a pair of wire barrel pieces 12B that extend to the left and right, and rise from the left and right edges of a bottom plate portion 12A to face each other. By pressing the wire barrel pieces 12B against the core wires 21 that are exposed from the insulating cover 22 at the front end of the aluminum electric wire 20 to wrap them inward, these wire barrel pieces 12B are crimped and electrically connected to the core wires 21. Note that the surface (inner surface) of the wire barrel 12 that comes into contact with the core wires 21 of the aluminum electric wire 20 is provided with a plurality of recessed serrations 12C to improve conduction to the core wires 21 and increase the retention strength of the core wires 21.

On the other hand, the insulation barrel 14 is also of the open barrel type, and is provided rearward of the wire barrel 12 with the interposed portion 13 interposed therebetween. A pair of insulation barrel pieces 14B (examples of crimping pieces), which are substantially rectangular with the same shape and size and are bilaterally symmetric, extend and rise from bilaterally symmetric positions at the left and right edges of the bottom plate portion 14A to face each other. In other words, the pair of insulation barrel pieces 14B have a shape extending in a left-right direction that intersects a longitudinal direction (front-rear direction) of the aluminum electric wire 20.

The pair of insulation barrel pieces 14B are wrapped around the outer circumference of the insulating cover 22 of the aluminum electric wire 20 placed on the bottom plate portion 14A, and are crimped in the radial direction to the outer circumferential surface of the insulating cover 22. When the pair of insulation barrel pieces 14B are crimped to the insulating cover 22, tip end portions 14C of the insulation barrel pieces 14B that have a flat surface shape face and abut against each other. Note that the length of the pair of insulation barrel pieces 14B is preset to have a desired compressibility with respect to the insulating cover 22 when the pair of insulation barrel pieces 14B are crimped to the insulating cover 22.

Figure 3:
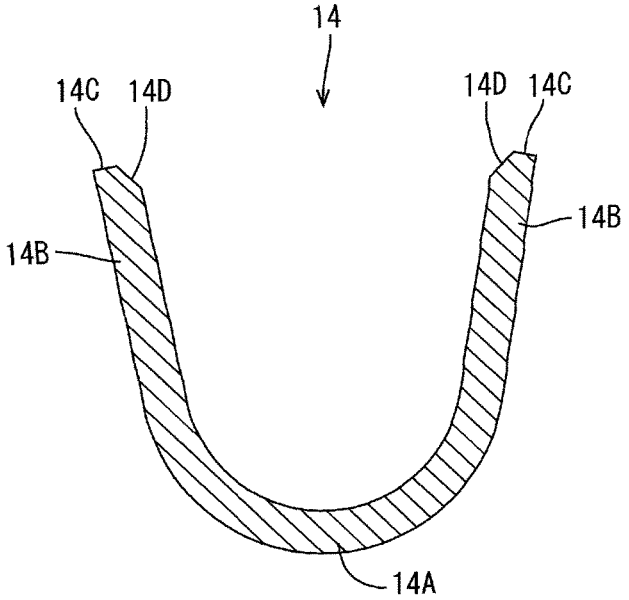
FIG. 3 is a cross-sectional view of an insulation barrel.
Figure 4:
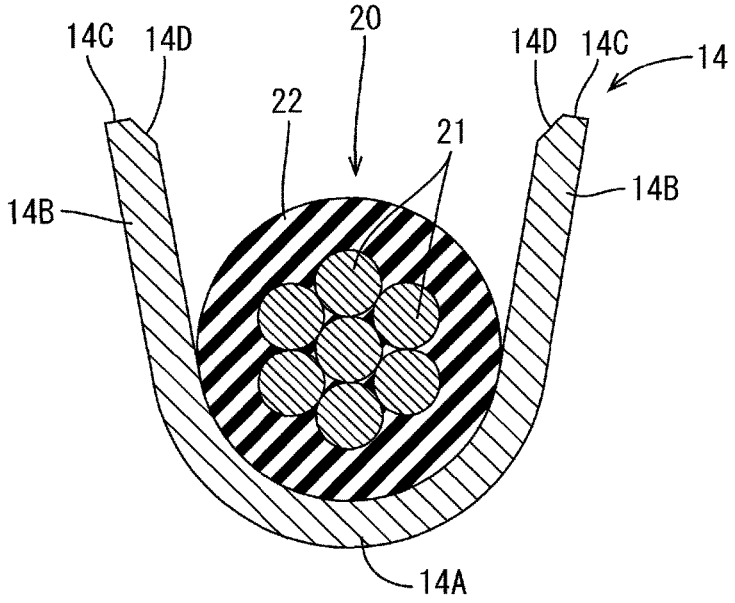
FIG. 4 is a cross-sectional view illustrating a state in which an aluminum electric wire is arranged in the insulation barrel.

Furthermore, as shown in FIGS. 2 and 3, the tip end portions 14C of the insulation barrel pieces 14B have, at their inner edges that are arranged on the insulating cover 22 side when the insulation barrel pieces are crimped to the insulating cover 22, corner portions that are cut off at an angle toward the tip end side extending in the longitudinal direction (front-rear direction) of the aluminum electric wire 20. The cut-off portions serve as inclined portions 14D. The inclined portions 14D are inclined toward the tip end side of the respective insulation barrel pieces 14B.

The following will describe a procedure in which the female terminal 10 and the aluminum electric wire 20 are assembled. First, the aluminum electric wire 20 in which the insulating cover 22 is stripped at an end and the core wires 21 are exposed is placed on the bottom plate portions 12A and 14A of the wire barrel 12 and the insulation barrel 14, and on the upper surface of the interposed portion 13 (see FIG. 4). Here, the aluminum electric wire 20 is placed so that a boundary portion between the core wires 21 and the insulating cover 22 is arranged on the interposed portion 13, and the position of the aluminum electric wire 20 in the front-rear direction with respect to the female terminal 10 is determined (see FIG. 1).

Then, the pair of wire barrel pieces 12B of the wire barrel 12 are crimped to the core wires 21 of the aluminum electric wire 20 to wrap them inward, and the pair of insulation barrel pieces 14B of the insulation barrel 14 are wrapped around and crimped to the insulating cover 22 of the aluminum electric wire 20.

During the crimping, when the wire barrel 12 is crimped on the core wires 21, hole edges of recesses of the serrations 12C bite into the core wires 21 to break oxide films formed on the core wires 21, and the wire barrel 12 is crimped and fixed to the core wires 21 firmly.

Figure 5:
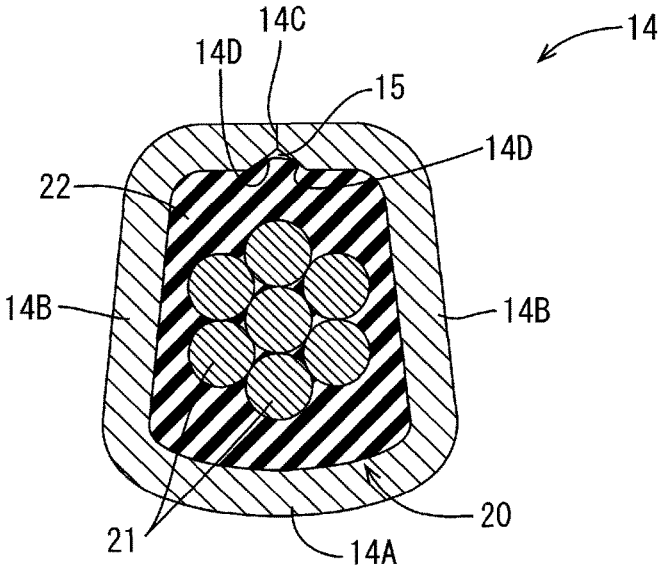
FIG. 5 is a cross-sectional view illustrating a state in which the insulation barrel is crimped to the aluminum electric wire.

On the other hand, when the insulation barrel 14 is crimped to the insulating cover 22, the pair of insulation barrel pieces 14B are wrapped around and pressed against the outer circumference of the insulating cover 22 so that their tip end portions 14C are flush with each other while facing and abutting against each other (see FIG. 5). Accordingly, a recessed portion 15 is formed by the pair of inclined portions 14D on the inner peripheral surface side of the abutting portions when the pair of insulation barrel pieces 14B are crimped to the insulating cover 22, the recessed portion 15 being recessed outward in the radial direction to have a cross section in a gentle mountain-like shape.

Furthermore, in such a crimped state, the inner peripheral surface (surface on the insulating cover 22 side) of the insulation barrel 14 is substantially smoothly contiguous. Specifically, although the above-described recessed portion 15 is formed, this recessed portion 15 (inclined portions 14D) is (are) smoothly contiguous to the inner peripheral surfaces of the insulation barrel pieces 14B except for the inclined portions 14D, in contrast to a right angel step or an acute angle edge.

Furthermore, the length of the pair of insulation barrel pieces 14B is preset to have a desired compressibility with respect to the insulating cover 22 when the insulation barrel 14 is crimped to the insulating cover 22, and thus the insulating cover 22 is compressed with an appropriate desirable compressibility.

As described above, by crimping and fixing the wire barrel 12 to the core wires 21, and crimping and fixing the insulation barrel 14 to the insulating cover 22, a terminal-equipped electric wire 30 is obtained in which the female terminal 10 is attached to an end of the aluminum electric wire 20.

The following will describe functions and effects of the female terminal 10 and the terminal-equipped electric wire 30 of the present embodiment. According to the terminal-equipped electric wire 30 of the present embodiment, the tip end portions 14C of the pair of insulation barrel pieces 14B abut against each other so as to be flush with each other in a state in which the insulation barrel 14 is crimped to the insulating cover 22, and thus the insulation barrel pieces 14B do not have, on the inner peripheral surface side on which they come into contact with the insulating cover 22, a portion that is locally and firmly pressed against the insulating cover 22. This prevents the insulating cover 22 from being bitten by an edge of the insulation barrel pieces 14B or the like and being damaged even when subjected to a high compression state.

Furthermore, when the insulation barrel 14 is strongly crimped, there may be cases where, in the process in which the pair of insulation barrel pieces 14B are pressed against each other, a part of the insulating cover 22 is pushed from the lower side to the upper side, and come close to being caught between the pair of tip end portions 14C. Even in such cases, the part that would have come close to being caught will escape into the recessed portion 15, and thus it is possible to prevent the part from being caught.

Therefore, it is possible to crimp the insulation barrel 14 to the insulating cover 22 with a higher compression than in the conventional case, and to achieve a female terminal 10 and a terminal-equipped electric wire 30 in which an insulation barrel 14 has high retention strength.

Other Embodiments

The technique disclosed in the present description is not limited to the foregoing embodiment explained with reference to the above description and the drawings, and encompasses, for example, the following various embodiments.

In the foregoing embodiment, the inclined portions 14D are provided at the edges on the inner peripheral side of the tip end portions 14C of the insulation barrel 14, but the inclined portions 14D are not essential.

In the foregoing embodiment, the tip end portions 14C of the insulation barrel pieces 14B have a flat surface shape, but the present invention is not limited to the flat surface shape, and may also have another configuration in which some recesses and projections such as serrations are provided, for example.

Figure 6:
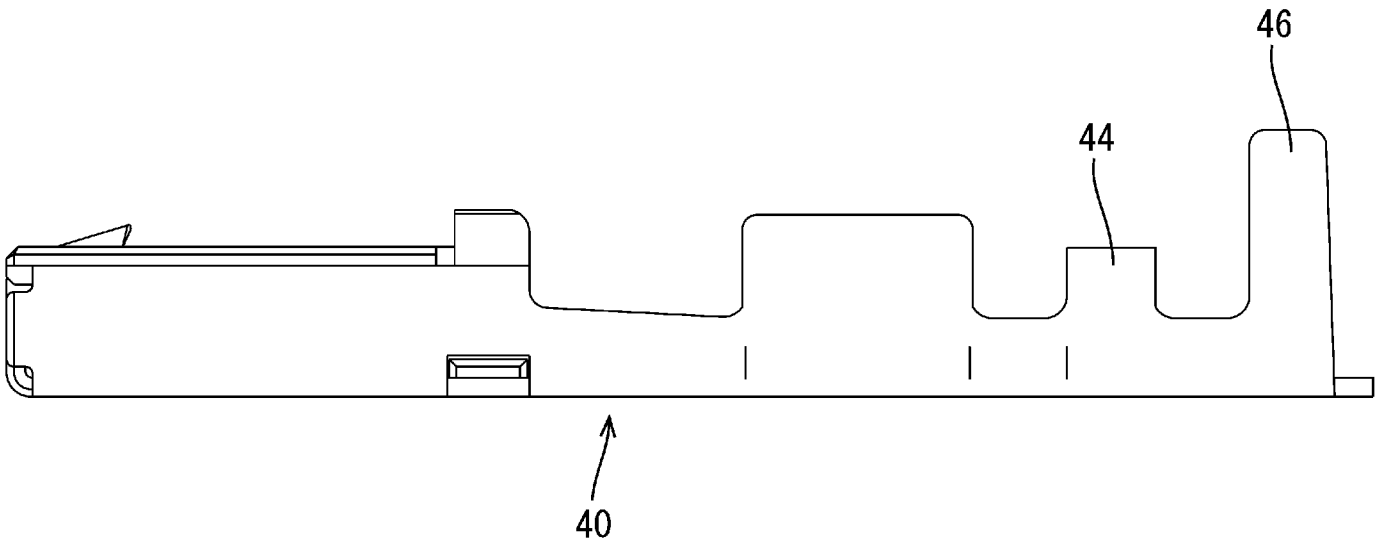
FIG. 6 is a side view illustrating a terminal according to another embodiment.

The type and shape of the terminal are not limited to those in the foregoing embodiment. For example, as shown in FIG. 6, the present invention may also be applicable to a terminal 40 that is integrally provided with a pair of rubber plug barrels 46 for holding rubber plugs on the rear side of an insulation barrel 44 having the same shape as that of the foregoing embodiment. Furthermore, the technique disclosed in the present description is broadly applicable to not only the female terminal 10 but also general terminals provided with an insulation barrel such as a male terminal provided with an insulation barrel to be crimped to the insulating cover 22.

It is to be understood that the foregoing is a description of one or more preferred exemplary embodiments of the invention. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation.

REFERENCE SIGNS LIST

10: Female terminal (terminal)
12: Wire barrel
13: Interposed portion
14: Insulation barrel
14B: Insulation barrel piece (crimping piece)
14C: Tip end portion
14D: Inclined portion
15: Recessed portion
20: Aluminum electric wire
21: Core wire
22: Insulating cover
30: Terminal-equipped electric wire

The invention claimed is:

1. A terminal that is to be connected to an end of an aluminum electric wire obtained by covering core wires with an insulating cover, comprising:

a pair of crimping pieces that extend in directions that intersect a longitudinal direction of the aluminum electric wire, and are crimped to an outer circumferential surface of the insulating cover, wherein tip end portions of the pair of crimping pieces have flat surfaces that face and abut against each other in a state in which the pair of crimping pieces are crimped to the insulating cover, and inner edge portions of the tip end portions that are arranged on the insulating cover side serve as inclined portions that are cut off at an angle toward the tip ends of the respective crimping pieces.

2. A terminal-equipped electric wire that is provided with: an aluminum electric wire obtained by covering core wires with an insulating cover; and the terminal according to claim 1 that is connected to the aluminum electric wire.

* * * * *